US007934672B2

(12) United States Patent
Sjöström et al.

(10) Patent No.: US 7,934,672 B2
(45) Date of Patent: May 3, 2011

(54) REFINER BLADE AND SEGMENT, AS WELL AS A METHOD OF FORMING THEM AND A METHOD OF MODIFYING BLADE GROOVES

(75) Inventors: Håkan Sjöström, Tampere (FI); Timo Könönen, Nokia (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 12/096,320

(22) PCT Filed: Dec. 4, 2006

(86) PCT No.: PCT/FI2006/050536

§ 371 (c)(1),
(2), (4) Date: Jun. 5, 2008

(87) PCT Pub. No.: WO2007/065971

PCT Pub. Date: Jun. 14, 2007

(65) Prior Publication Data

US 2008/0302897 A1 Dec. 11, 2008

(30) Foreign Application Priority Data

Dec. 5, 2005 (FI) ..... 20055648

(51) Int. Cl.
*B02C 7/12* (2006.01)

(52) U.S. Cl. ..... 241/296; 241/261.2

(58) Field of Classification Search ..... 241/261.2, 241/261.3, 296, 297, 298
See application file for complete search history.

(56) References Cited

U.S. PATENT DOCUMENTS

| | | | | |
|---|---|---|---|---|
| 2,035,994 | A | 3/1936 | Sutherland, Jr. | |
| 5,467,931 | A * | 11/1995 | Dodd | 241/261.2 |
| 7,347,392 | B2 * | 3/2008 | Johansson | 241/28 |
| 2005/0039615 | A1 | 2/2005 | Chupka et al. | |
| 2005/0161542 | A1 | 7/2005 | Theut | |
| 2006/0192040 | A1 | 8/2006 | Johansson | |
| 2007/0057102 | A1 | 3/2007 | Virving | |
| 2007/0084952 | A1 | 4/2007 | Sjostrom et al. | |
| 2008/0149291 | A1 | 6/2008 | Johansson | |

FOREIGN PATENT DOCUMENTS

| | | |
|---|---|---|
| FR | 2 394 638 | 1/1979 |
| SU | 408973 | 11/1973 |
| WO | WO 2004/067178 A1 | 8/2004 |
| WO | WO 2005/032721 A1 | 4/2005 |
| WO | WO 2006/093582 | 9/2006 |

* cited by examiner

*Primary Examiner* — Mark Rosenbaum
(74) *Attorney, Agent, or Firm* — Alston & Bird LLP

(57) ABSTRACT

A refiner blade comprising a blade surface for defibrating a lignocellulose-containing material, the blade surface comprising blade bars and blade grooves provided therebetween. At least one blade groove provided in the blade surface is formed by removing material from the blade surface by water cutting.

30 Claims, 2 Drawing Sheets

REFINER BLADE AND SEGMENT, AS WELL AS A METHOD OF FORMING THEM AND A METHOD OF MODIFYING BLADE GROOVES

BACKGROUND OF THE INVENTION

The invention relates to a refiner blade comprising a blade surface for defibrating a lignocellulose-containing material, the blade surface comprising blade bars and blade grooves provided therebetween.

The invention also relates to a blade segment of a refiner blade, comprising a blade surface for defibrating a lignocellulose-containing material, the blade surface comprising blade bars and blade grooves provided therebetween.

The invention relates to a refiner blade comprising a blade surface for defibrating a lignocellulose-containing material, the blade surface comprising first blade bars and first blade grooves provided therebetween, and the first blade bars comprising second blade bars and second blade grooves provided therebetween and arranged to connect the first blade grooves.

The invention further relates to a blade segment of a refiner blade, comprising a blade surface for defibrating a lignocellulose-containing material, the blade surface comprising first blade bars and first blade grooves provided therebetween, the first blade bars comprising second blade bars and second blade grooves provided therebetween and arranged to connect the first blade grooves.

The invention still further relates to a method of forming blade grooves in a blade surface of a refiner blade or a refiner blade segment, the blade surface being provided for defibrating a lignocellulose-containing material.

The invention still further relates to a method of modifying blade grooves provided in a blade surface of a refiner blade or in a blade surface of a refiner blade segment for defibrating a lignocellulose-containing material.

Refiners for processing a fibrous material typically comprise two, but possibly also more, oppositely situated refiner blades, at least one of which is arranged to rotate around an axle such that the refiner blades turn with respect to one another. In disc refiners, the shape of the refiner blade is dislike, in cone refiners conical, and in cylinder refiners cylindrical.

The blade surfaces, i.e. refiner surfaces, of refiner blades for refiner discs typically consist of protrusions, i.e. blade bars, provided in the blade surface and blade grooves provided between the blade bars. Hereinafter, blade bars may also be called bars and blade grooves may also be called grooves. A refiner blade may consist of one uniform piece or of two or more blade segments arranged adjacent to one another, in which case the blade surfaces of the blade segments together form a uniform blade surface of the refiner blade.

Conventionally, both whole refiner blades and blade segments are manufactured by casting in sand moulds which are provided with forms that correspond with the blade bars and blade grooves in the blade surface of the refiner blade. When either whole refiner blades or blade segments are manufactured by casting, a problem is that in practice certain minimum size requirements which depend on the size of a casting piece exist for the size of the blade bars and blade grooves. A large casting piece cannot be provided with a blade pattern formed by blade bars and blade grooves that would be denser than a certain blade pattern, because molten metal would then not fill up the space for the blade bars in the mould, the result being an incomplete blade surface. The densest blade pattern to be arranged in a refiner blade of a disc refiner having a diameter of 1000 mm and a blade bar height of 10 mm and manufactured by casting in one piece, for instance, is presently a pattern wherein the minimum width of a blade bar is 3 mm and the minimum width of a groove is 4 mm. When a blade pattern denser than this is to be manufactured, a refiner blade has to be formed using blade segments, in which case casting enables a blade pattern to be achieved wherein with a 6 mm blade bar height the narrowest possible bar width is 1.6 mm and the narrowest possible groove width is 2 mm.

Blade surfaces of whole refiner blades or single blade segments may also be manufactured by welding or soldering blade bars into the body of a whole refiner blade or a blade segment. However, when manufacturing blades with a dense blade pattern, fastening of the blade bars requires a large amount of both manufacturing work to produce single blade bars and welding and soldering work in order to fasten them, which means that to manufacture a refiner blade is a time-consuming process even though it could at least partly be carried out automatically.

A further problem shared by all the manufacturing methods mentioned above is that prior to putting the refiner blade to use, the grooves and bars of the blade surface often also have to be finished off so as to remove e.g. welding or casting fins and sprues.

BRIEF DESCRIPTION OF THE INVENTION

An object of the present invention is to provide a novel and improved method of forming blade grooves in a blade surface of a refiner blade or of a blade segment.

A refiner blade according to the invention, comprising a blade surface for defibrating a lignocellulose-containing material, the blade surface comprising blade bars and blade grooves provided therebetween, is characterized in that at least one blade groove provided in the blade surface is formed by removing material from the blade surface by water cutting.

Furthermore, a blade segment according to the invention, comprising a blade surface for defibrating a lignocellulose-containing material, the blade surface comprising blade bars and blade grooves provided therebetween, is characterized in that at least one blade groove provided in the blade surface is formed by removing material from the blade surface by water cutting.

Furthermore, a refiner blade according to the invention, comprising a blade surface for defibrating a lignocellulose-containing material, the blade surface comprising first blade bars and first blade grooves provided therebetween, and the first blade bars comprising second blade bars and second blade grooves provided therebetween and arranged to connect the first blade grooves, is characterized in that a width of the second blade grooves is 0.3 to 1.0 mm.

Furthermore, a blade segment of a refiner blade according to the invention, comprising a blade surface for defibrating a lignocellulose-containing material, the blade surface comprising first blade bars and first blade grooves provided therebetween, and the first blade bars comprising second blade bars and second blade grooves provided therebetween and arranged to connect the first blade grooves, is characterized in that a width of the second blade grooves is 0.3 to 1.0 mm.

Furthermore, a method according to the invention of forming blade grooves in a blade surface of a refiner blade or a refiner blade segment is characterized by providing the blade surface of the refiner blade or the blade surface of the refiner blade segment with at least one blade groove by removing material from the blade surface by water cutting.

Furthermore, a method according to the invention of modifying blade grooves provided in a blade surface of a refiner blade or in a blade surface of a refiner blade segment for defibrating a lignocellulose-containing material is characterized by modifying at least one blade groove provided in the blade surface of the refiner blade or in the blade surface of the refiner blade segment by changing the shape of a cross-section of the blade groove by removing material from the blade surface by water cutting.

According to an embodiment, the refiner blade thus comprises a blade surface for defibrating a lignocellulose-containing material, the blade surface comprising blade bars and blade grooves provided therebetween, such that at least one blade groove provided in the blade surface is formed by removing material from the blade surface by water cutting. According to a second embodiment, the blade surface of the refiner blade comprises first blade bars and first blade grooves provided therebetween, and the first blade bars further comprise second blade bars and second blade grooves provided therebetween and arranged to connect the first blade grooves. According to a third embodiment, at least one of the second blade grooves is formed by removing material from the blade surface by water cutting.

An advantage of using water cutting for forming grooves in the blade surface of the refiner blade is that water cutting enables the depth of a groove being formed to be readily adjusted by changing the rate at which a nozzle feeding water and an abrasive material is moved. Also, water cutting causes no metallurgical changes to the blade surface of the refiner blade. Water cutting is particularly usable for forming extremely narrow grooves, which is practically impossible by casting.

BRIEF DESCRIPTION OF THE DRAWINGS

Some embodiments of the invention are disclosed in greater detail in the accompanying drawings, in which FIG. 1 schematically shows a blade segment of a disc refiner as seen in a direction of a blade surface.

For the sake of clarity, the figures show some embodiments of the invention in a simplified manner. In the figures, like reference numbers refer to like elements.

DETAILED DESCRIPTION OF SOME EMBODIMENTS OF THE INVENTION

Figure 1:
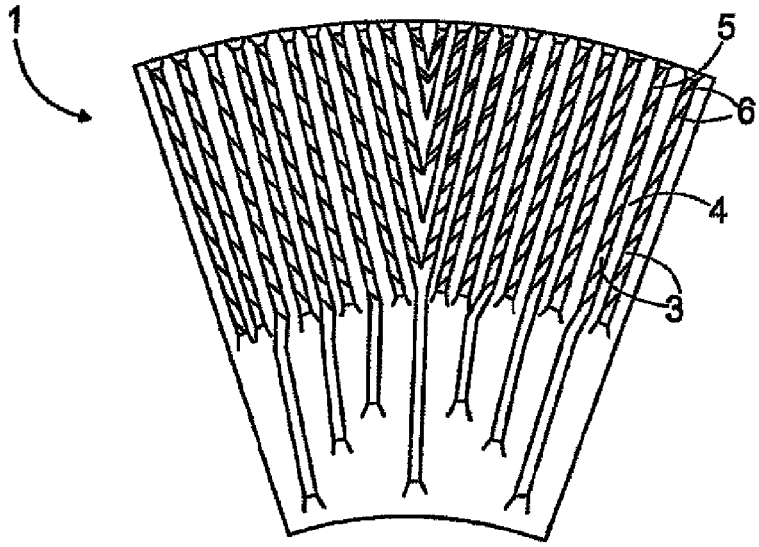
Figure 2:
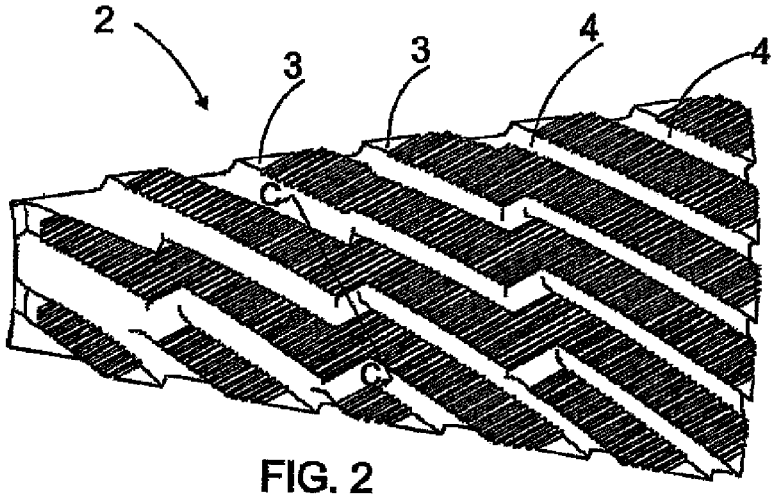
FIG. 2 schematically shows a blade segment of a cone refiner as seen in a direction of a blade surface.
Figure 3:
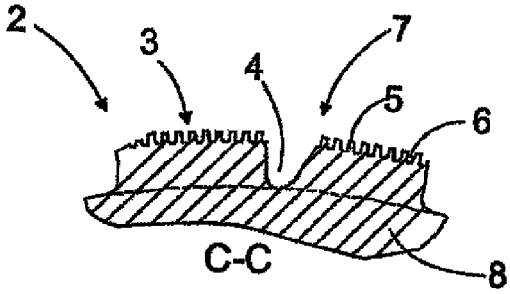
FIG. 3 schematically shows a cross-section of the blade segment according to FIG. 2, taken along line C-C.
Figure 4:
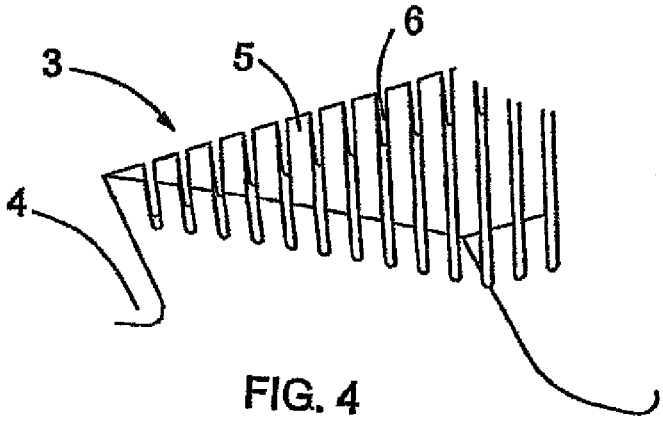
FIG. 4 schematically shows a part of a blade bar in a blade surface.
Figure 7:
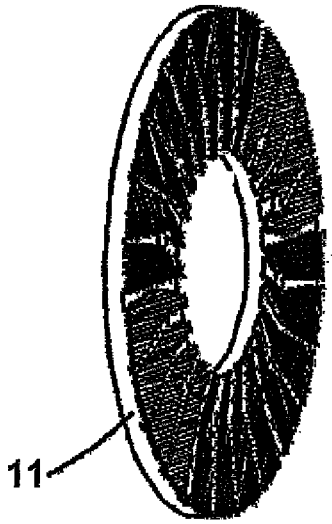
FIG. 7 is a schematic perspective view of a whole refiner blade for a disc refiner.

FIG. 1 schematically shows a blade segment 1 of a disc refiner as seen in a direction of a blade surface, FIG. 2 schematically shows a blade segment 2 of a cone refiner as seen in a direction of a blade surface, FIG. 3 schematically shows a cross-section of the blade segment 2 according to FIG. 2, taken along line C-C in FIG. 2, and FIG. 4 schematically shows a part of a blade bar as a perspective view. The blade segments 1 and 2 according to FIGS. 1 and 2 are thus provided for forming a part of a blade surface of one refiner blade for a disc refiner and a cone refiner. The blade segments 1 and 2 are provided with first blade bars 3, i.e. first bars 3, and first blade grooves 4, i.e. first grooves 4, therebetween. An upper surface of the first bars 3 is provided with second blade bars 5, i.e. second bars 5, and second blade grooves 6, i.e. second grooves 6, therebetween. The second bars 5 and the second grooves 6 can be seen more clearly in FIGS. 3 and 4. The blade segments 1 and 2, as typically whole blades as well, consist of a blade surface 7 and a blade body 8 such that no grooves belonging to the pattern of the blade surface 7 are extended into the area of the blade body 8, as shown more clearly in FIG. 3. A whole refiner blade 11 for a disc refiner is schematically shown as a perspective view in FIG. 7.

Depending on the material to be refined and on the desired refining result, the dimensions of the first bars 3, first grooves 4, second bars 5 and second grooves 6 may vary in many different ways. The width of the first bars 3 may range e.g. between 15 and 80 mm. In some applications, such a range may be 20 to 40 mm. The width of the first grooves 4 provided between the first bars 3 may be e.g. 5 to 40 mm, and in some applications such a range may also be 10 to 30 mm. Both the first bars 3 and the first grooves 4 may be formed such that their width either remains the same or it changes in the direction of travel of the bars and grooves. The depth of the grooves 4, in turn, may be e.g. 10 to 40 mm. The grooves 4 may also be formed such that the depth of the grooves either remains the same or it changes in the direction of travel of the grooves. As the width and/or depth of the grooves 4 changes, it can thus be stated that the cross-sectional area or volume of the groove 4 changes. The flow cross-sectional area of the grooves 4 may thus vary e.g. between 0.5 and 12 $cm^2$. The shape of the first bars 3 may be either straight, as schematically shown in FIG. 1, or curved at a constant angle or at a changing angle, as schematically shown in FIG. 2. Naturally, the shape of the first bars 3 dictates the shape of the grooves 4 provided therebetween.

The width of the second grooves 6 provided in the upper surface of the first bars 3 may be at least 0.3, e.g. 0.3 to 1.0 mm. A width of 0.7 to 1.0 mm of the second grooves also provides advantages to be disclosed below, as compared with previous blade solutions. The width of the second bars 5 residing between the second grooves 6 may also be e.g. 1 to 3 mm. An average width of the first bars 3 is thus about 3.8 to 62 times the total width of the second bars 5 and the second grooves 6. The depth of the second grooves 6 may be e.g. 2 to 6 mm. The depth of the grooves 6 may remain the same or it may change in the direction of travel of the grooves. In practice, the largest depth of the grooves 6 is dictated by the thickness of the wear surface set for the blade surfaces 7.

The width of the second bars 5 and the second grooves 6 may be constant or it may change in the direction of travel thereof. The width of the grooves 6 may change both in the direction of travel of the grooves 6 and in the lateral direction thereof. The second bars 5 and the second grooves 6 may be formed in the upper surface of the first bars 3 also such that they provide an angle of about 5 to 30 degrees with respect to a radius of the blade surface 7 or a reference direction halving the blade surface 7.

The upper surface of the first bars 3 is thus provided with a dense grooving, i.e. a micro grooving, for refining a lignocellulose-containing material. These densely-grooved, i.e. micro-grooved, areas which have been formed in the upper surface of the bars 3 constitute the actual refiner zones of the blade segments 1 and 2, which thus carry out the task of refining the lignocellulose-containing material. The total surface area of these micro-grooved refiner zones may be about 60 to 90%, in some applications about 70 to 80%, of the total surface area of the blade surfaces 7. A task of the grooves 4 residing between the first bars 3 is to convey fibre material to be refined to the refiner zones as well as to convey the refined material away from between the blade surfaces 7 of the refiner. In addition, a task of the first grooves 4 is to convey steam that has possibly been generated during the refining process away from between the blade surfaces 7 of the refiner.

The blade surface described above enables refining by using an extremely low blade load without the hydraulic capacity of the refiner being decreased. Normally, when refining long-fibred cellulose by using short-fibre blades for refining short fibres, no sufficient hydraulic capacity is achieved, in which case the blades of the refiner become congested. In the disclosed blade surface 7, the large first grooves 4 enable an optimal and even feed of the fibre material to be refined to be achieved over the entire area of the refiner surface. The densely-situated second bars 5 and the second grooves 6 which are provided in the upper surface of the first bars 3 and which constitute the refiner zones of the blade surfaces 7 enable the blade surface to be provided with a very high cutting length. The disclosed blade surface 7 thus enables a desired capacity as well as a good quality of the refined mass to be achieved. Further, the disclosed blade surface 7 is highly suitable for refining both long and short fibres. Still further, the disclosed blade surface enables the same change in the quality or strength as compared with a previous change to be achieved with a lower specific consumption of energy. Furthermore, at the same fibre cutting length the refiner may be used at a higher load than previously, without blade contact. Short-fibre refining may be carried out with a smaller number of refiners than before, since a refiner may be used at a higher capacity than before without the fibre length of short fibres becoming smaller. The second grooving which is denser than previously further enables the diameter of a refiner blade to be decreased while retaining the load capacity of the retainer. Due to the smaller diameter, the no-load capacity decreases, in which case more of the energy used by the refiner is used for improving the characteristics of the fibres than before. A special feature that has been noticed is that the disclosed fine refiner blade also enables very short and weak fibres and, on the other hand, highly refined fibres to be refined at a good load capacity without opposite blade surfaces of the refiner coming into contact with one another.

The manufacture of blade surfaces 7 according to FIGS. 1 to 4 and equipped with micro-grooved refiner zones either by using one uniform refiner blade or by using separate blade segments is technically impossible to carry out by casting. Due to the large number and small size of the single blade bars, the second blade bars 5 in particular, the formation of blade bars as separate bars and the welding or soldering thereof is extremely laborious, which increases production costs and time, even if the process could be automated to some extent.

The blade surfaces 7 may be formed such that the blade surfaces 7 are provided with grooves by removing material from the blade surfaces 7 by water cutting. During water cutting, a water jet 10 is directed at the blade surface 7 of either a whole refiner blade or a blade segment 1, 2 via a nozzle 9 (FIGS. 5 and 6) at high pressure at a point in the blade surface 7 at which a groove is to be formed. An abrasive material, selected on the basis of the characteristics of the material the refiner blade has been made of, is mixed with the water jet so that when coming into contact with the blade surface 7, the abrasive material removes material from the blade surface. Water cutting as a work method is known per se to those skilled in the art, so it will not be explained in greater detail herein.

When blade surfaces for refiner blades are manufactured by water cutting, several significant advantages are achieved. Water cutting enables grooves to be made which are 0.3 to 1 mm wide at their smallest. Irrespective of the size of an object, water cutting thus enables a blade surface to be manufactured wherein the width of the blade bar is as small as 1 mm and the width of a groove is e.g. as small as 0.3 to 1.0 mm, in some cases e.g. 0.7 to 1.0 mm. When sand is used as the abrasive material in water cutting, it is possible to reach the aforementioned groove width of 0.7 mm. If a material finer than sand, such as a powder, is used as the abrasive material, a groove width as narrow as 0.3 mm may be achieved. When the blade surface, or at least a part thereof, is manufactured by water cutting, it is possible to make blades with a clearly denser pattern than by using current casting or welding methods. Water cutting does not cause metallurgical changes in the steel being worked, either. After water cutting, the blade surface has a visibly matt-surfaced or uneven finish which is unique to water cutting, most typically at the termination points of the water-cut grooves.

Figure 5:
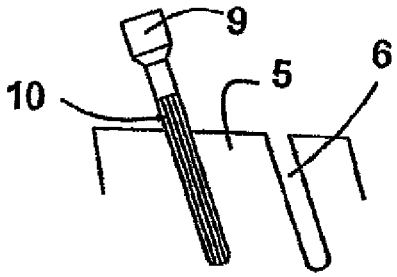
FIGS. 5 and 6 schematically show formation of a blade groove by removing material from a blade surface.
Figure 6:
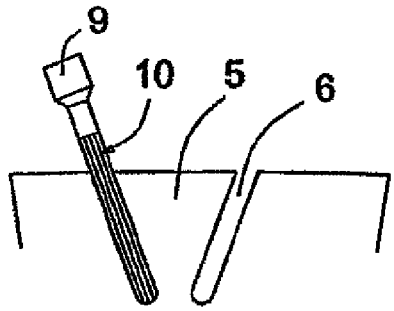

The depth of a groove being formed may be easily adjusted by changing the rate at which the nozzle 9 feeding water and abrasive material is moved. By changing the directional angle of the water jet 10, the water jet may also be directed obliquely to the blade surface, which enables blade bars with sloping surfaces to be easily formed, as shown by FIGS. 5 and 6. The cross-sectional profile of the blade groove may also be changed by removing material from the blade bars restricting the blade groove; such a method may be used for changing the cross-sectional profiles of blade grooves of new blade surfaces or for modifying the blade grooves of used blades already being used so as to better suit some other material to be refined. It is also quicker to form the grooving of a blade surface by water cutting than by a conventional casting technique since no new casting model is necessary. A blade surface produced by water cutting is also ready to be put to use immediately after the water cutting, since the blade surface no longer has to be subjected to any special work phases to finish it off, such as removal of casting or welding fins or sprues from the cast or welded blades. Water cutting also enables an easy formation of grooves that curve in the direction of their travel, which are difficult and expensive to manufacture by a casting technique. The example of FIG. 6 further shows two adjacent narrow grooves 6, the left-hand groove 6 still in a water cutting phase, whose angles of inclination are opposite to one another. In practice, it is not even possible to manufacture by a casting technique a refiner blade provided with grooves having angles of inclination opposite to one another as shown in FIG. 6, because it is impossible to remove the casting model from the blade solution according to FIG. 6 without breaking the casting model.

The blade surfaces 7 of the blade segments 1 and 2 according to FIGS. 1 and 2 or of whole blades may be manufactured in numerous different ways. According to an embodiment, water cutting is used for forming both the large or wide grooves, i.e. the first grooves 4, and the narrow or small grooves, i.e. the second grooves 6, of the blade surfaces 7. Water cutting thus also enables grooves with a width of more than 1 mm to be manufactured easily. According to another embodiment, first grooves 4 are formed in the blade segments 1 and 2 or in blades made as whole blades during casting thereof by means of a casting model, and after the casting, the upper surface of the first bars 3 is provided with second bars 5 and second grooves 6 by means of water cutting. An advantage of this solution is that the water cutting does not have to be used for removing a large amount of material for the first grooves 4 whose operation is not in practice affected by any small manufacturing defects in the casting, but water cutting is only used for forming the second bars 5 and the second grooves 6 which require removal of a smaller amount of material but yet very accurate machining and which constitute the refiner surfaces that carry out the actual refining work.

The most significant advantage achieved by water cutting technique is in connection with blades that are cast in one piece since water cutting enables an extremely dense blade pattern formed by grooves and bars to be produced in the blades such that the blade pattern is denser than a blade pattern that can be achieved in refiner blades to be assembled from separate blade segments made by casting. An important advantage achieved by this is in connection with low-consistency refiners when the refiner blade may be manufactured from one piece, in which case no special fastening cones are any longer needed for separate blade segments. Similarly, an important advantage is achieved in connection with refiners for which no refiner blade solution involving separate blade segments has been available. Furthermore, refiner blades with a blade pattern that until now could be manufactured using separate blade segments only can now be manufactured as whole refiner blades from the start.

When blades manufactured by water cutting were tested in short-fibre refining, it was found out that it is now possible to use water cutting to manufacture a blade whose cutting length is clearly greater than that of a blade manufactured by casting. In the refining behaviour of a refiner, such a greater cutting length implies a possible higher load capacity of the refiner, i.e. opposite blade surfaces of the refiner do not come into contact with one another even at high refining powers, and a quicker change in the refining level without the fibre length becoming shorter, i.e. a higher refining efficiency.

Although a use of the solution has been disclosed in connection with a process of forming grooves in the blade surfaces 7 of the blade segments 1 and 2, the disclosed solution may as well be utilized both when manufacturing blade surfaces consisting of one whole piece and when manufacturing a blade surface for separate blade segments. The disclosed method may as well also be used when manufacturing new grooves in old refiner blades.

The figures show utilization of the solution when manufacturing blade surfaces of a disc refiner and blade surfaces of a cone refiner, but the same solution may naturally be utilized in the manufacture of blade surfaces of a cylinder refiner as well. The basic structure of a disc refiner, a cone refiner and a cylinder refiner is known per se to those skilled in the art, so it will not be discussed in closer detail herein.

The disclosed solution is suitable for the manufacture of low-consistency blades, defibrator blades as well as fibreboard blades. A relatively low rotation speed is characteristic of low-consistency refiners, the peripheral velocity of the outer periphery of the refiner blade typically being about 19 to 33 m/s. The cutting angle of the refiner blades of low-consistency refiners is typically relatively large, about 20 to 70 degrees. The blades of a low-consistency refiner are driven towards a closed position or towards each other until the motor reaches a selected efficiency. When consistency is low, opposite blade surfaces of the refiner may come into contact with one another, which is why the refiner blades of a low-consistency refiner have to endure such a contact with opposite blade surfaces, so that the material the blades are made of have to be tenacious. If the refiner blade of a low-consistency refiner is provided with a large number of blade bars, the refiner takes more power without opposite blade surfaces coming into contact with one another.

In defibrators, the rotation speed is 1500 rpm when the frequency of the electrical power network is 50 Hz, and 1800 rpm when the frequency of the electrical power network is 60 Hz, the peripheral velocities of the outer periphery of a refiner blade with a 1690 mm outer diameter being 133 m/s and 159 m/s, respectively. Typically, the blade edges of the refiner blades of defibrators are almost radial, meaning that they have a small cutting angle. Defibrators are driven by blade span control. Typically, a blade span is 0.5 to 1 mm, but smaller blade spans are also possible. Since in defibrators opposite blade surfaces do not come into contact with one another, the refiner blades of a defibrator may be manufactured from a metal which is harder than that used for the refiner blades of a low-consistency refiner.

In some cases, the features disclosed in the present application may be used as such, irrespective of other features. On the other hand, the features disclosed in this application may be combined so as to produce different combinations, when necessary.

The drawings and the related description are only intended to illustrate the idea of the invention. In its details, the invention may vary within the scope of the claims.

The invention claimed is:

1. A refiner blade comprising:

a blade surface for defibrating a lignocellulose-containing material, the blade surface comprising:

first blade bars and first blade grooves provided therebetween; and at least one second blade groove provided in the blade surface, the second blade groove being formed on an upper surface of at least one of the first blade bars by removing material from the blade surface by water cutting, the upper surface of each of the first blade bars being substantially parallel to a corresponding refining plane at the time of manufacture of the refiner blade.

2. A refiner blade as claimed in claim 1, wherein the first blade bars comprise second blade bars and second blade grooves provided therebetween and arranged to connect the first blade grooves.

3. A refiner blade as claimed in claim 2, wherein at least one of the second blade grooves is formed by removing material from the blade surface by water cutting.

4. A refiner blade as claimed in claim 2, wherein at least one of the first blade grooves is formed by casting in a casting mould while the refiner blade is being cast.

5. A refiner blade as claimed in claim 2, wherein a width of the second blade grooves is at least 0.3 mm.

6. A refiner blade as claimed in claim 2, wherein the width of the second blade grooves is 0.3 to 1.0 mm.

7. A refiner blade as claimed in claim 2, wherein the width of the second blade grooves is 0.7 to 1.0 mm.

8. A refiner blade as claimed in claim 2, wherein a width of the second blade bars is 1 to 3 mm.

9. A refiner blade as claimed in claim 2, wherein a width of the first blade bars is 15 to 80 mm and a width of the first blade grooves is 5 to 40 mm.

10. A blade segment of a refiner blade, the blade segment comprising:

a blade surface for defibrating a lignocellulose-containing material, the blade surface comprising:

first blade bars and first blade grooves provided therebetween; and at least one second blade groove provided in the blade surface, the second blade groove being formed on an upper surface of at least one of the first blade bars by removing material from the blade surface by water cutting, the upper surface of each of the first blade bars being substantially parallel to a corresponding refining plane at the time of manufacture of the refiner blade.

11. A blade segment as claimed in claim 10, wherein the first blade bars comprise second blade bars and second blade grooves provided therebetween and arranged to connect the first blade grooves.

12. A blade segment as claimed in claim 11, wherein at least one of the second blade grooves is formed by removing material from the blade surface by water cutting.

13. A blade segment as claimed in claim 11, wherein at least one of the first blade grooves is formed by casting in a casting mould while the blade segment is being cast.

14. A blade segment as claimed in claim 11, wherein a width of the second blade grooves is at least 0.3 mm.

15. A blade segment as claimed in claim 11, wherein the width of the second blade grooves is 0.3 to 1.0 mm.

16. A blade segment as claimed in claim 11, wherein the width of the second blade grooves is 0.7 to 1.0 mm.

17. A blade segment as claimed in claim 11, wherein a width of the second blade bars is 1 to 3 mm.

18. A blade segment as claimed in claim 11, wherein a width of the first blade bars is 15 to 80 mm and a width of the first blade grooves is 5 to 40 mm.

19. A refiner blade comprising a blade surface for defibrating a lignocellulose-containing material, the blade surface comprising first blade bars and first blade grooves provided therebetween, and the first blade bars comprising second blade bars and second blade grooves provided therebetween, the second blade bars and second blade grooves being formed on an upper surface of at least one of the first blade bars and arranged to connect the first blade grooves, the upper surface of each of the first blade bars being substantially parallel to a corresponding refining plane at the time of manufacture of the refiner blade, and wherein a width of the second blade grooves is 0.3 to 1.0 mm.

20. A refiner blade as claimed in claim 19, wherein the width of the second blade grooves is 0.7 to 1.0 mm.

21. A refiner blade as claimed in claim 19, wherein a width of the second blade bars is 1 to 3 mm.

22. A refiner blade as claimed in claim 19, wherein a width of the first blade bars is 15 to 80 mm and a width of the first blade grooves is 5 to 40 mm.

23. A refiner blade as claimed in claim 19, wherein at least one of the second blade grooves is formed by water cutting material off the blade surface of the refiner blade.

24. A refiner blade as claimed in claim 19, wherein the refiner blade comprises a blade body and a blade surface manufactured of one uniform material.

25. A blade segment of a refiner blade, comprising a blade surface for defibrating a lignocellulose-containing material, the blade surface comprising first blade bars and first blade grooves provided therebetween, and the first blade bars comprising second blade bars and second blade grooves provided therebetween, the second blade bars and second blade grooves being formed on an upper surface of at least one of the first blade bars and arranged to connect the first blade grooves, the upper surface of each of the first blade bars being substantially parallel to a corresponding refining plane at the time of manufacture of the refiner blade, and wherein a width of the second blade grooves is 0.3 to 1.0 mm.

26. A blade segment as claimed in claim 25, wherein the width of the second blade grooves is at least 0.7 to 1.0 mm.

27. A blade segment as claimed in claim 25, wherein a width of the second blade bars is 1 to 3 mm.

28. A blade segment as claimed in claim 25, wherein a width of the first blade bars is 15 to 80 mm and a width of the first blade grooves is 5 to 40 mm.

29. A blade segment as claimed in claim 25, wherein at least one of the second blade grooves is formed by water cutting material off the blade surface of the blade segment.

30. A blade segment as claimed in claim 25, wherein the blade segment comprises a blade body and a blade surface manufactured of one uniform material.

* * * * *